US011566188B2

(12) United States Patent
Xu et al.

(10) Patent No.: US 11,566,188 B2
(45) Date of Patent: Jan. 31, 2023

(54) METHODS OF WHOLE CRUDE AND WHOLE CRUDE WIDE CUT HYDROTREATING LOW HETROATOM CONTENT PETROLEUM

(71) Applicant: ExxonMobil Technology and Engineering Company, Annandale, NJ (US)

(72) Inventors: Xiaochun Xu, Basking Ridge, NJ (US); Xinrui Yu, Furlong, PA (US); Shifang Luo, Annandale, NJ (US); Randolph J. Smiley, Hellertown, PA (US); Hyung S. Woo, Easton, PA (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/325,869

(22) Filed: May 20, 2021

(65) Prior Publication Data

US 2021/0363439 A1 Nov. 25, 2021

Related U.S. Application Data

(60) Provisional application No. 63/028,896, filed on May 22, 2020.

(51) Int. Cl.

| | |
|---|---|
| ***C10G 67/14*** | (2006.01) |
| ***C10G 69/04*** | (2006.01) |
| ***C10G 69/08*** | (2006.01) |

(52) U.S. Cl.

CPC ..... *C10G 67/14* (2013.01); *C10G 69/04* (2013.01); *C10G 69/08* (2013.01);

(Continued)

(58) Field of Classification Search

CPC ..... C10G 11/18; C10G 2300/107; C10G 2300/202; C10G 2300/301; C10G 2300/307; C10G 2300/308; C10G 2300/4006; C10G 2300/4012; C10G 2300/4018; C10G 2300/4081;

(Continued)

(56) References Cited

U.S. PATENT DOCUMENTS

| | | | | |
|---|---|---|---|---|
| 2013/0292299 | A1* | 11/2013 | Koseoglu | C10G 65/12 208/97 |
| 2017/0009155 | A1* | 1/2017 | Oprins | C10G 69/06 |
| 2018/0142172 | A1* | 5/2018 | Gosling | C10G 69/00 |

OTHER PUBLICATIONS

International Search Report and Written Opinion PCT/US2021/-33556 dated Aug. 31, 2021.

(Continued)

*Primary Examiner* — Ellen M McAvoy
*Assistant Examiner* — Chantel L Graham
(74) *Attorney, Agent, or Firm* — Shook, Hardy & Bacon L.L.P.

(57) ABSTRACT

Method of refining whole crude oil or a wide cut crude oil, the methods comprising a combination of a hydrotreating reactor, a distillation tower, and an optional flash evaporation separator. The methods can also include light ends processing, fluid catalytic cracking, reforming, hydrocracking, and demetalization. In some methods a whole crude oil is first processed through a flash evaporation separator to create a wide cut crude oil and in other methods, the flash evaporation separator is not used as the whole crude oil is first treated in a hydrotreater.

22 Claims, 8 Drawing Sheets

(52) U.S. Cl.
CPC . *C10G 2300/107* (2013.01); *C10G 2300/202* (2013.01); *C10G 2300/301* (2013.01); *C10G 2300/307* (2013.01); *C10G 2300/308* (2013.01); *C10G 2300/4006* (2013.01); *C10G 2300/4012* (2013.01); *C10G 2300/4018* (2013.01); *C10G 2400/04* (2013.01)

(58) Field of Classification Search
CPC ..... C10G 2400/02; C10G 2400/04; C10G 35/104; C10G 45/08; C10G 47/00; C10G 63/06; C10G 65/12; C10G 67/14; C10G 69/04; C10G 69/08; C10G 69/14
See application file for complete search history.

(56) References Cited

OTHER PUBLICATIONS

International Preliminary Report on Patentability received for PCT Application No. PCT/US2021/033556, dated Dec. 1, 2022, 8 pages.

* cited by examiner

METHODS OF WHOLE CRUDE AND WHOLE CRUDE WIDE CUT HYDROTREATING LOW HETROATOM CONTENT PETROLEUM

CROSS-REFERENCE TO RELATED APPLICATIONS

This application claims the benefit of U.S. Provisional Application No. 63/028,896, filed on May 22, 2020, the entire contents of which are incorporated herein by reference.

FIELD

The present disclosure relates to methods of whole crude and whole crude wide cut hydrotreating low heteroatom content petroleum.

BACKGROUND

Conventional crude oil supplies tend to be sour heavy crude. That is crude oil high in heteroatoms sulfur, nitrogen) and other contaminates. Refining sour heavy crude conventionally comprises heating and distilling the crude oil into separate product streams. The product streams are then individually hydrotreated to reduce sulfur and other contaminants. This step is especially important in light of modern low sulfur fuel requirements. However, the multiple hydrotreating reactors consume significant quantities of hydrogen and have a high operational energy cost/carbon footprint.

Tight oil, also known as shale oil, is light sweet crude with a low heteroatom content. Development of hydraulic fracturing and horizontal well drilling technologies has significantly increased the supply of tight oil available for refining. Refining tight oil in process flows originally developed for conventional crude oil may be inefficient. The tow contamination levels of tight oil may present opportunities to reconfigure traditional crude oil process flows by reordering and/or eliminating some process and thus reduce capital investment, operational energy cost/carbon footprint and maximize revenue.

SUMMARY

The present disclosure relates to methods of hydrotreating whole crude and whole crude wide cut low heteroatom content petroleum.

Methods of refining whole crude oil, the method comprising: providing a hydrotreating reactor, a distillation tower, and an optional flash evaporation separator, and a whole crude oil stream; feeding the whole crude oil stream into the hydrotreating reactor; processing the whole crude oil stream within the hydrotreating reactor to create a treated stream; feeding the treated stream into the distillation tower; and processing the treated stream within the distillation tower to create one or more petroleum distillate streams.

Methods of refining whole crude oil, the method comprising: providing a flash evaporation separator, a hydrotreating reactor, a distillation tower, and a whole crude oil stream; feeding the whole crude oil stream into the flash evaporation separator; processing the whole crude oil stream within the flash evaporation separator to create a plurality of flashed streams comprising a kero plus stream and at least one of a light ends stream and a flashed naphtha stream; feeding the kero plus stream into the hydrotreating reactor; processing the kero plus stream within the hydrotreating reactor to create a treated stream; and processing the treated stream within the distillation tower.

Methods of refining whole crude oil, the method comprising: providing a flash evaporation separator, a hydrotreating reactor, a distillation tower, and a whole crude oil stream; feeding the whole crude oil stream into the flash evaporation separator to create a flash light ends stream, a flash middle stream, and a flash heavy ends stream; processing the flash middle stream within the hydrotreating reactor to create a treated stream; feeding the treated stream into the distillation tower; and processing the treated stream within the distillation tower to create one or more petroleum distillate streams.

Methods of refining whole crude oil, the method comprising: providing a flash evaporation separator, a hydrotreating reactor, a distillation tower, and a whole crude oil stream; feeding the whole crude oil stream into the flash evaporation separator to create a flash light ends stream and a flash heavy ends stream; processing the flash light ends stream within the hydrotreating reactor to create a treated stream; feeding the treated stream into the distillation tower; and processing the treated stream within the distillation tower to create one or more petroleum distillate streams.

BRIEF DESCRIPTION OF THE DRAWINGS

The following figures are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

DETAILED DESCRIPTION

Figure 1:
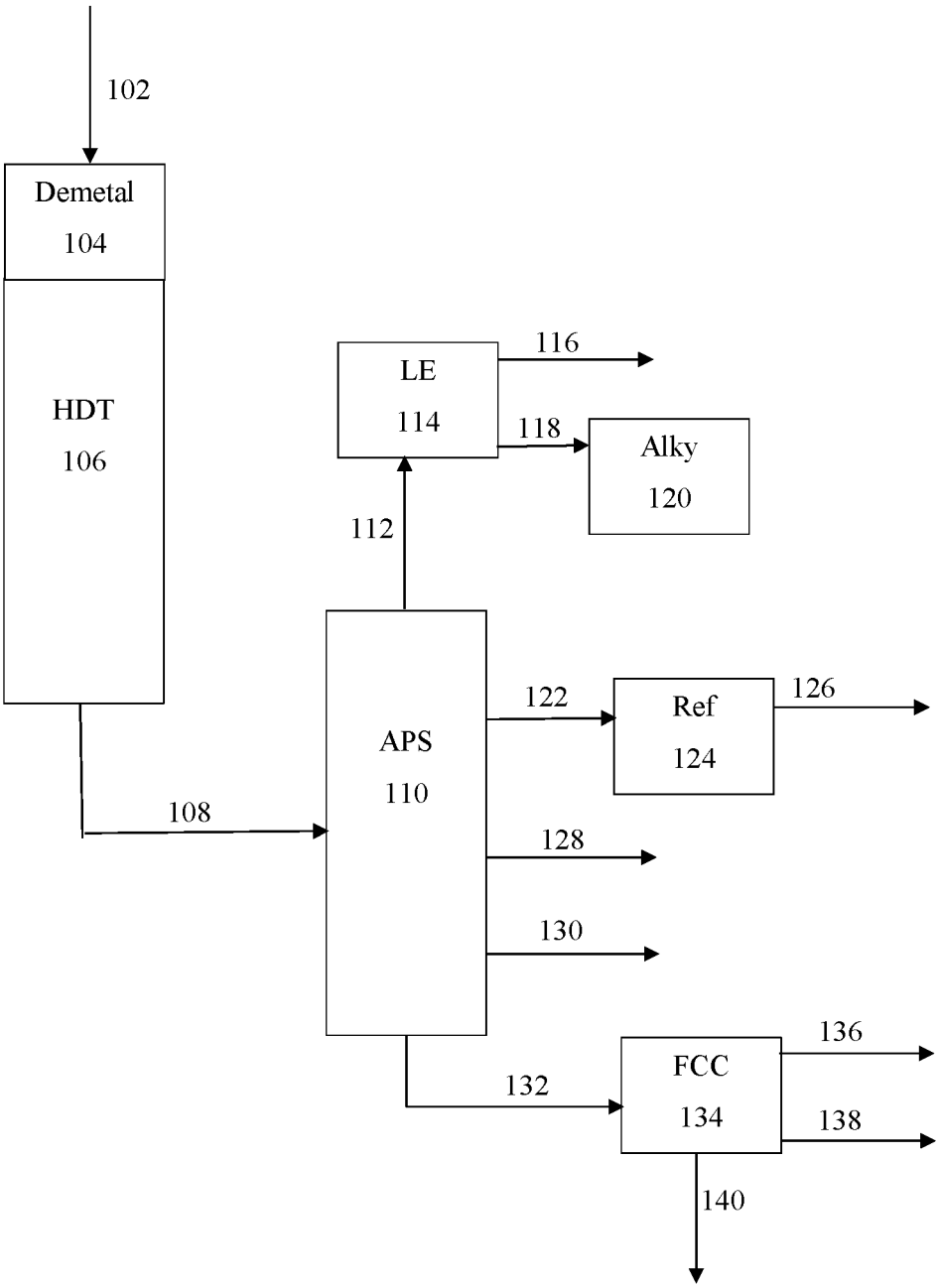
FIG. 1 illustrates a whole crude hydrotreating process flow.

The present disclosure relates to methods of whole crude and whole crude wide cut hydrotreating low heteroatom content petroleum. Whole crude hydrotreating is hydrotreating a whole crude petroleum before distillation. Whole crude wide cut hydrotreating is flash separating and then hydrotreating a whole crude petroleum before distillation.

There are numerous advantages to hydrotreating a whole crude petroleum having low heteroatom content (tight oil) before distillation. Whole crude tight oil may be hydrotreated by a single reactor before distillation because of the low contamination content. Placing a single hydrotreating reactor before a distillation tower eliminates the need for independent hydrotreating reactors on each distilled product stream, which reduces capital building and maintenance expenditures. Also, a single pre-distillation tower hydrotreating reactor consumes significantly less energy compared to operating multiple hydrotreating reactors post-distillation. The whole crude hydrotreating of tight oil is also hydrogen self-sufficient. The hydrogen consumption is only about 20% of the amount generated by the reformer. The excess hydrogen generated by the reformer may be supplied to other processes in the refinery, further reducing the overall carbon footprint.

Whole crude wide cut hydrotreating has further advantages over whole crude hydrotreating. Tight oil generally has a high naphtha fraction (typically 30-50 wt %) and low sulfur content. Flash evaporating tight oil separates it to light ends, naphtha, and a kero plus remainder fraction. While the low sulfur content of tight oil may permit the naphtha fraction the go directly from the flash evaporation separator to a reformer without hydrotreating, but hydrotreating the naphtha fraction is preferred. Naphtha is typically vaporized in hydrotreating reactors and reduces the hydrogen partial pressure, which negatively impacts hydrotreating performance. Separating the naphtha before hydrotreating improves the hydrotreating reactor performance while significantly reducing the required reactor size.

Flash evaporation and hydrotreating whole crude tight oil will also minimize fouling and corrosion in the atmospheric distillation unit and catalyst poisoning downstream, which further reduces operational expenses. Other advantages may be further achieved by the present disclosure.

Definitions and Test Methods

As used in the present disclosure and claims, the singular forms "a," "an," and "the" include plural forms unless the context clearly dictates otherwise.

The term "and/or" as used in a phrase such as "A and/or B" herein is intended to include "A and B", "A or B", "A", and "B".

As used herein, a reference to a "$C_x$" fraction, stream, portion, feed, or other quantity is defined as a fraction (or other quantity) where 50 vol % or more of the fraction corresponds to hydrocarbons having "x" number of carbons. When a range is specified, such as "$C_x$-$C_y$", 50 vol % or more of the fraction corresponds to hydrocarbons having a number of carbons from "x" to "y". A specification of "$C_{x+}$" (or "$C_{x-}$") corresponds to a fraction where 50 vol % or more of the fraction corresponds to hydrocarbons having the specified number of carbons or more (or the specified number of carbons or less).

The term "hydrocarbon" means a class of compounds containing hydrogen bound to carbon, and encompasses (i) saturated hydrocarbon, (ii) unsaturated hydrocarbon, mixtures of hydrocarbons, and including mixtures of hydrocarbon compounds (saturated and/or unsaturated) having different values of n.

As used herein, "feedstock" and "feed" (and grammatical derivatives thereof) are used interchangeably and both refer to a composition that is fed into a reactor. A feedstock may optionally have been pre-treated to modify its disposition.

The term "reactor" and grammatical derivatives thereof refers to a vessel comprising one or more catalyst beds.

Tight Oil

Tight oil (also known as shale oil, shale-hosted oil, or light tight oil) is a light sweet crude oil contained in petroleum hearing formations of low permeability. The development of hydraulic fracturing and horizontal well drilling technology has significantly increased the domestic production of tight oil and thus incentivized developing efficient refining processes to optimize financial returns. Table 1 below shows properties of a typical tight oil.

TABLE 1

| | |
|---|---|
| API | 48.5 |
| Total Sulfur, wt % | 0.012 |
| Aliphatic Sulfur wt % | 0.004 |
| Nitrogen ppm | 42.5 |
| Basic Nitrogen, ppm | 16.5 |
| Aromatics, wt % | 7.8 |
| Paraffins, wt % | 49.4 |
| Naphthenes, wt % | 42.8 |
| ASTM D2887, ° F. | |
| 5 wt % | 137 |
| 10 wt % | 178 |
| 30 wt % | 298 |
| 50 wt % | 421 |
| 70 wt % | 587 |
| 90 wt % | 822 |
| 95 wt % | 912 |

ASTM D2887 refers to the method titled "Standard Test Method For Boiling Range Distribution Of Petroleum Fractions By Gas Chromatography," such that the numbers above refer to the fact that 5 wt % of the tight oil boils at 37° F. (T5) and 95 wt % of the tight oil boils by 912° F. (T95).

Further, oil having an API gravity above 31.1° is considered light crude. Oil having an API gravity between 40° and 50° commands the highest price. Referring to Table 1 above, the API gravity of the typical tight oil sample was about 48.5°, Sweet crude oil generally has less than 0.5 wt % sulfur. Typical tight oil also has very low sulfur, with the sample tested above in Table 1 showing 0.012 wt % sulfur. Another useful property of tight oil is the naphthene composition, with the sample tested above in Table 1 showing a naphthene concentration of 42.8 wt %.

Flash Evaporation Separator

The term "flashing" or "flash separator" "flash evaporation" are, used as a general process term descriptive of the process of removing, components of crude oil via heating and/or depressurization that results in vaporizing volatile components from the liquid state. Of note, when flashing the naphtha flash temperature is generally 300-350° F. but can be as high as 430° F. For wider-cut flash points, light ends and naphtha flash from the initial boiling point (IBP) to about 350° F. and kerosene and above flash from about 350° F. to the final boiling point.

Hydrotreating

The term "hydrotreating" is used as a general process term descriptive of the reactions in which a prevailing degree of hydrodesulfurization, hydrodenitrogenation and hydrodeoxygenation occurs. Olefins saturation and aromatic saturation take place as well and its degree depends on the catalyst and operating conditions selected.

The catalysts used for hydrotreatment can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VIB metal (Column 6 of IUPAC periodic table), preferably Mo and/or W. Such hydroprocessing catalysts can optionally include transition metal sulfides. These metals or mixtures of metals are typically present as oxides or sulfides on refractory metal oxide supports. Suitable metal oxide supports include low acidic oxides such as silica, alumina, Mania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support.

The at least one Group VIII non-noble metal, in oxide form, can typically be present in an amount ranging from about 2 wt % to about 40 wt %, preferably from about 4 wt % to about 15 wt %. The at least one Group VIB metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybdenum:tungsten ratio preferably lies in the range of 9:1-1:9. Preferably the Group VIII non-noble metal comprises nickel anchor cobalt. It is further preferred that the Group VIB metal comprises a combination of molybdenum and tungsten. Preferably, combinations of nickel/molybdenum/tungsten and cobalt/molybdenum/tungsten and nickel cobalt molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the hulk metal hydrotreating catalysts be approximately the same as the one of conventional hydrotreating catalysts. Bulk metal hydrotreating catalysts have a pore volume of 0.05-5 ml/g, or of 0.1-4 ml/g, or of 0.1-3 ml/g or of 0.1-2 ml/g determined by nitrogen adsorption. Preferably, pores smaller than 1 nm are not present. The bulk metal hydrotreating catalysts can have a median diameter of at least 100 nm. The bulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen containing "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrotreating conditions can include temperatures of about 200° C. to about 450° C. or about 315° C. to about 425° C.; pressures of about 250 psig (1.8 MPag) to about 5000 psig (34.6 MPag) or about 300 psig (2.1 MPag) to about 3000 psig (20.8 MPag); liquid hourly space velocities (LHSV) of about 0.1 $hr^{-1}$ to about 10 $hr^{-1}$; and hydrogen treat gas rates of about 200 scf/B (35.6 $m^3/m^3$) to about 10,000 scf/B (1781 $m^3/m^3$), or about 500 (89 $m^3/m^3$) to about 10,000 scf/B (1781 $m^3/m^3$).

Because the hydrotreatment reactions that take place in this step are exothermic, a rise in temperature takes place along the reactor. The conditions in the hydrodesulfurization step may be adjusted to obtain the desired degree of desulfurization. A temperature rise of about 5° F. to about 200° C. is typical under most hydrotreating conditions and with reactor inlet temperatures in the 500° F. to 800° F. range.

Turning now to FIG. 1, a schematic representation of a whole crude hydrotreating process flow for low heteroatom content petroleum is illustrated. A whole crude tight oil stream 102 is first processed through demetalization reactor beds 104. The demetalization process may include a traditional catalytic process known to one of ordinary skill in the art. Tight oil may contain higher iron and calcium content than convention crude. Tight oil metal content may include calcium from 0.5-20 ppm, iron from 0.1-8.5 ppm, nickel from 0-0.5 ppm, and vanadium from 0-1.3 ppm. After flowing through the demetalization reactor beds 104, the whole crude tight oil petroleum stream 102 is then processed in a hydrotreating reactor 106. A treated stream 108 is created and flows from the hydrotreating reactor 106 to be processed in an atmospheric distillation tower 110. There the treated stream 108 is distilled into multiple petroleum distillate streams.

A first petroleum distillate stream 112, comprising atmospheric top end distillates, flows into a light ends processing unit 114 to produce a light ends treated streams 116, which may contain methane, ethane and LPG. The variety and composition of the light ends treated streams 116 may depend on the desired output and separation processes utilized in the light ends processing unit 114, iso-butane stream 118 also flows from the light ends processing unit 114 into an alkylation unit 120 for further processing.

A second petroleum distillate stream 122, comprising primarily naphtha, flows from the atmospheric distillation tower 110 to a naphtha upgrading process, such as isomerization and reformer processes 124. The second petroleum distillate stream 122 may be further processed in the naphtha upgrading reformer 124 to produce a reformed stream 126, which may comprise low sulfur high-octane gasoline and/or pure chemical feedstocks (benzene, toluene, xylene, which may also be known as BTX). Hydrogen generated from reformation process can be used in the whole crude hydrotreating. The second petroleum distillate stream 122 may also be further processed using the combination of isomerization and reformer, in which light naphtha (C5-C7) is isomerized and heavy naphtha (C7+) is processed using reformer. A third petroleum distillate stream 128, comprising ultralow sulfur kerosene (ULSK) is also formed, in some cases the ULSK stream may flow directly to fuel stocks without requiring further processing. A fourth petroleum distillate stream 130 is also formed, comprising ultralow-sulfur diesel (ULSD), it too may flow directly to fuel stocks without requiring further processing.

A fifth petroleum distillate stream 132 comprising the atmospheric bottom end may flow directly into a fluid catalytic cracker 134 (FCC). Hydrotreating the whole crude tight oil stream 102 before fractioning in the atmospheric distillation tower 110 results in the fifth petroleum distillate stream 132 having low sulfur, nitrogen, and aromatics. The high quality (low contamination) of the fifth petroleum distillate stream 132 flowing into the FCC 134 results in high quality (low contamination) FCC product streams that may be directly blended to other product streams without further processing. Leaving the FCC 134 is naphtha stream 136, low sulfur light cycle oil (LCO) stream 138, and low sulfur slurry oil stream 140. The naphtha stream 136 may be directly blended with gasoline from the reformer stream 126. A light cycle oil stream 138 may flow from the FCC to be directly blended with ULSD from the fourth petroleum distillate stream 130. A very low sulfur slurry oil product stream 140 may be sold as fuel for Emission Control Area (ECA) fuel and/or used as a blending component for low sulfur Marine Gas Oil (MGO).

Figure 2:
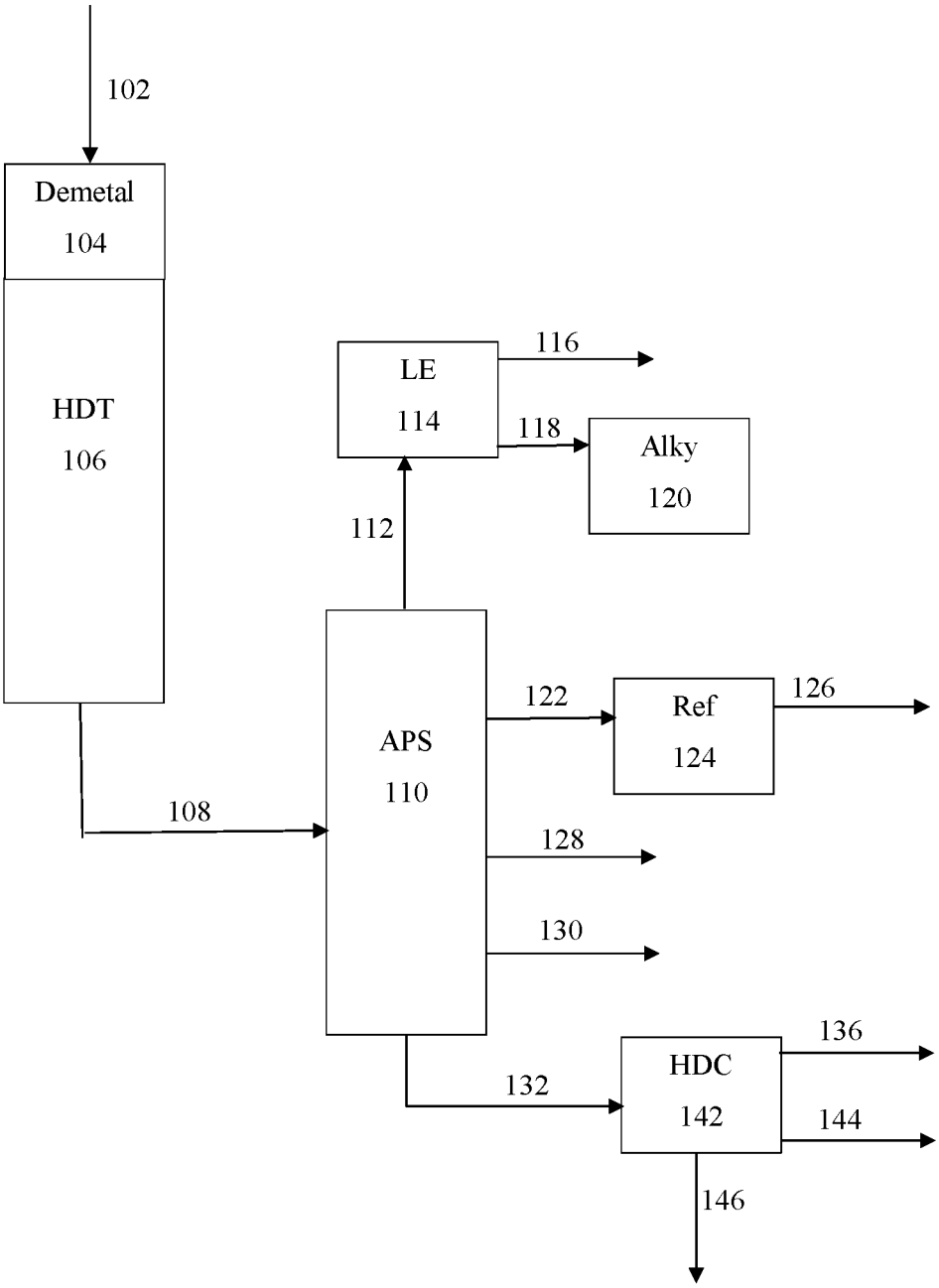
FIG. 2 depicts another aspect of a whole crude hydrotreating process flow.

It is contemplated that hydrotreating the whole crude tight oil stream 102, which begins as a low heteroatom content petroleum, provides flexibility in processing depending on the desired distillation products. FIG. 2 depicts the process flow 100 for refining low heteroatom content petroleum with a different configuration for processing the fifth petroleum distillate stream 132 (atmospheric bottom end). References numbers that are shared between the figures refer to the same elements across the figures. The low nitrogen content of the fifth petroleum distillate stream 132 allows for replacing the FCC 134 with a hydrocracker 142 (HDC)capable of producing several different product streams without any pre-treatment. Just as with FCC 134, HDC 142 is shown as producing three product streams. The first two are the same as produced in FIG. 1: naphtha stream 136 and diesel stream 144. The third product stream from HDC 142 is a lubricant product stream 146, which may comprise a variety of different products depending on process configuration and catalyst choice may be produced by the HDC 142.

Figure 3:
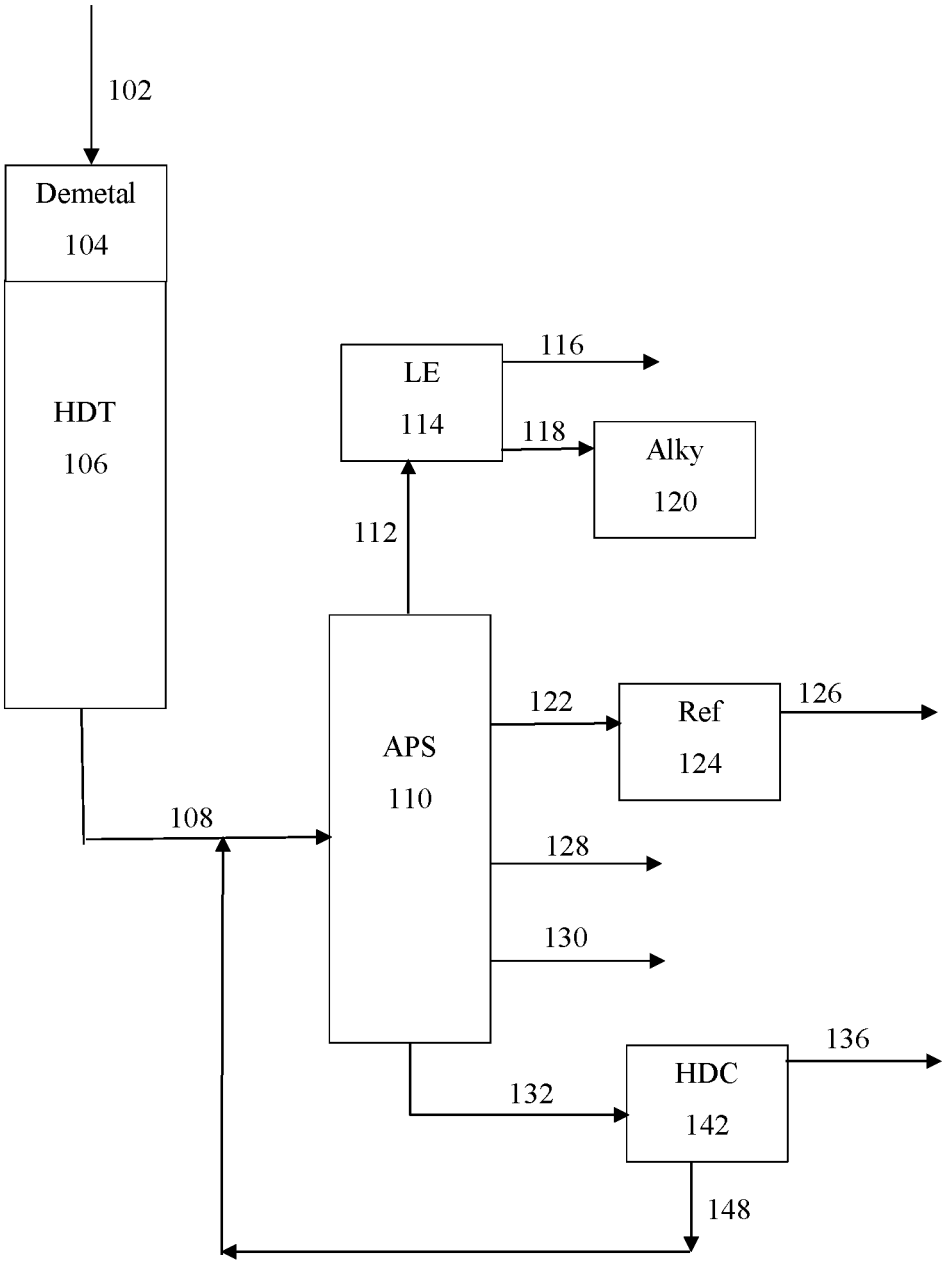
FIG. 3 depicts a further aspect of a whole crude hydrotreating process flow.

FIG. 3 depicts another possible configuration for the process flow 100 for refining low heteroatom content tight oil with a different configuration for processing the fifth petroleum distillate stream 132 (atmospheric bottom end). If diesel fuel is the primary target product, a HDC product stream 148 may be fed back into the atmospheric distillation tower 110 increasing the yield of ULSD in the fourth petroleum distillate stream 130. One of skill in the art will recognize that while the process can typically achieve conversion of heavy products of over 95%, it will still be necessary to provide a bleed steam to avoid heavy aromatic build up.

It is contemplated that hydrotreating a whole crude tight oil having low heteroatom content as depicted in FIGS. 1-3 results in simplified distillate product streams. As a result of the simplified distillate product streams the process is more flexible and significant cost savings may be realized either through reductions in energy consumption and/or capital expenditures to build and operate the process.

Figure 4:
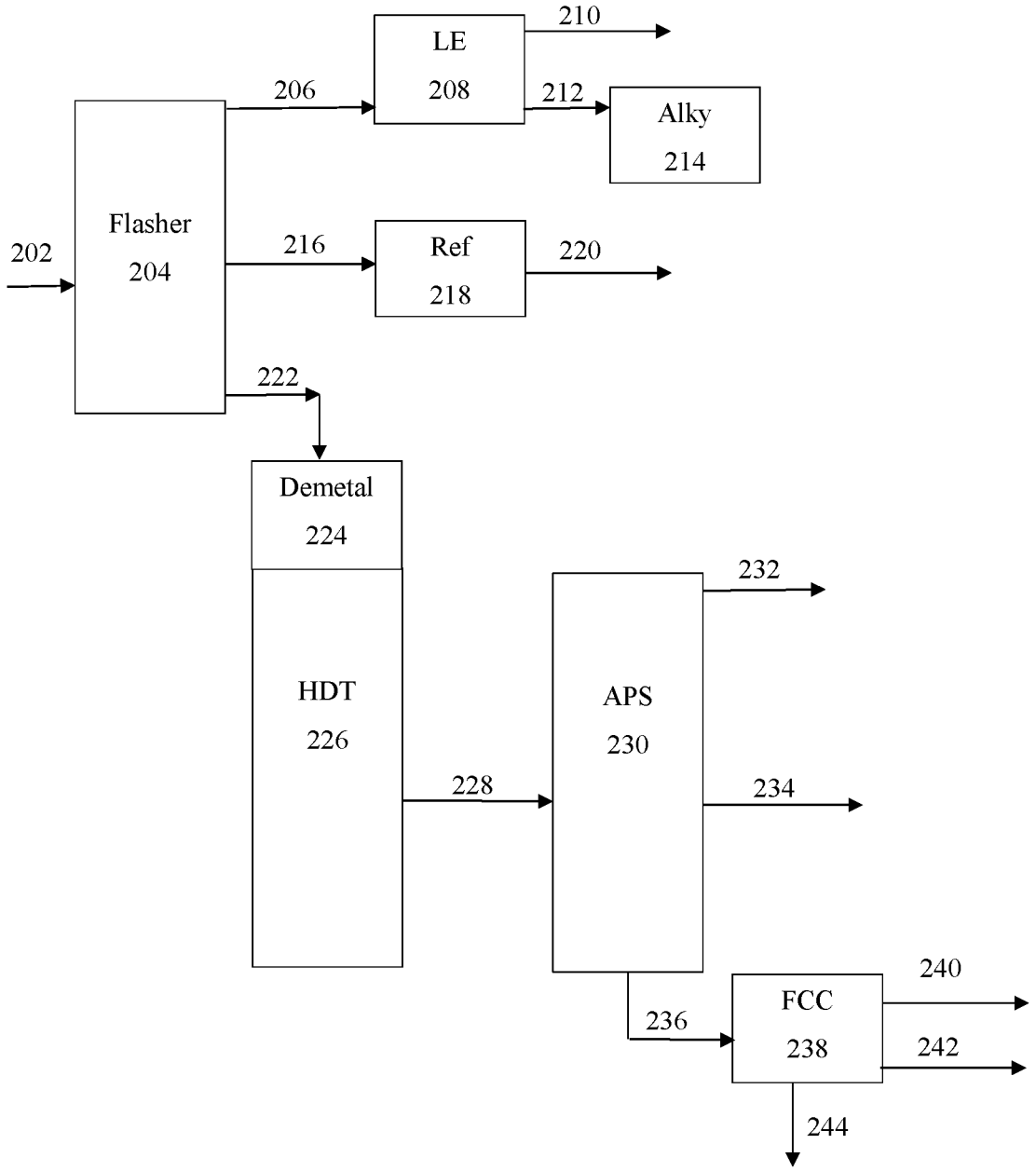
FIG. 4 illustrates a whole crude wide cut hydrotreating process flow.

Turning now to FIG. 4, a whole crude refining process flow is depicted that refines a whole crude tight oil stream 202. Whole crude tight oil stream 202 flows into the flash separator 204 to begin the refining process. A first flash product stream 206 comprises the same atmospheric top end distillates as the first petroleum distillate stream 112 in process flow 100 flows in to a light ends processing unit 208 to produce a light ends treated streams 210, which may contain a variety of products. The variety and composition of the light ends treated streams 210 may depend on the desired output and separation processes utilized in the light ends processing unit 208. An iso-butane stream 212 also flows from the light ends processing unit 208 into an alkylation unit 214 for further processing.

A second flash product stream 216 comprises naphtha. The low sulfur content and high naphtha concentration the whole crude tight oil stream 202 may permit flowing the second flash product stream 216 directly into a naphtha reformer 218 to produce a reformed stream 220, which may comprise low sulfur high-octane gasoline and/or pure chemical feedstocks (benzene, toluene, xylene, which may also be known as BTX). In some circumstances, it may be desirable to hydrotreat the second flash product stream 216 before it is directed into a naphtha reformer 218. The low sulfur content permit the reformer stream 220 to be added directly to the gasoline product stream without additional desulfurization.

The remaining fraction from the flash separator 204 is a kero plus stream 222 comprising kerosene and the remaining heavy fractions of the whole crude tight oil stream 202. The kero plus stream 222 is first processed through demetalization reactor beds 224 and then processed in a hydrotreating reactor 226. A treated stream 228 flows from the hydro treating reactor 226 to be processed in an atmospheric distillation tower 230. There the treated stream 228 is distilled into multiple petroleum distillate streams.

The distillate streams produced by the atmospheric distillation tower 230 are simplified and reduced as a result of the flash separator 204 removing the light ends and naphtha components of the whole crude tight oil stream 202, such that the atmospheric distillation tower 230 produces three streams. A first petroleum distillate stream 232 comprises ULSK and, in some cases, may flow directly to fuel stocks without requiring further processing. A second petroleum distillate stream 234 comprises ULSD and may also, in some cases, flow directly to fuel stocks without requiring further processing. Similar to the atmospheric bottom end in process flow 100, a third petroleum distillate stream 236 has low sulfur, nitrogen, and aromatics that may remove the requirement for any pre-treating before being fed into FCC 238. Similar to the FCC process in process flow 100, the FCC 238 may produce multiple product streams. As shown in FIG. 4, three product streams are produced: naphtha stream 240, light cycle oil stream 242, and low sulfur slurry oil stream 244. The naphtha stream 240 may be directly blended with gasoline from the reformer stream 220. Similarly, the light cycle oil stream 242 may flow from the FCC 238 to be directly blended with ULSD from the second petroleum distillate stream 234. Finally, a very low sulfur slurry oil product stream 244 may be used as a blending component for low sulfur MGO. Thus, similar to the process flow 100, flash separating and hydrotreating the whole crude tight oil stream 202 before atmospheric distillation provides flexibility in the post-distillation processing options.

Figure 5:
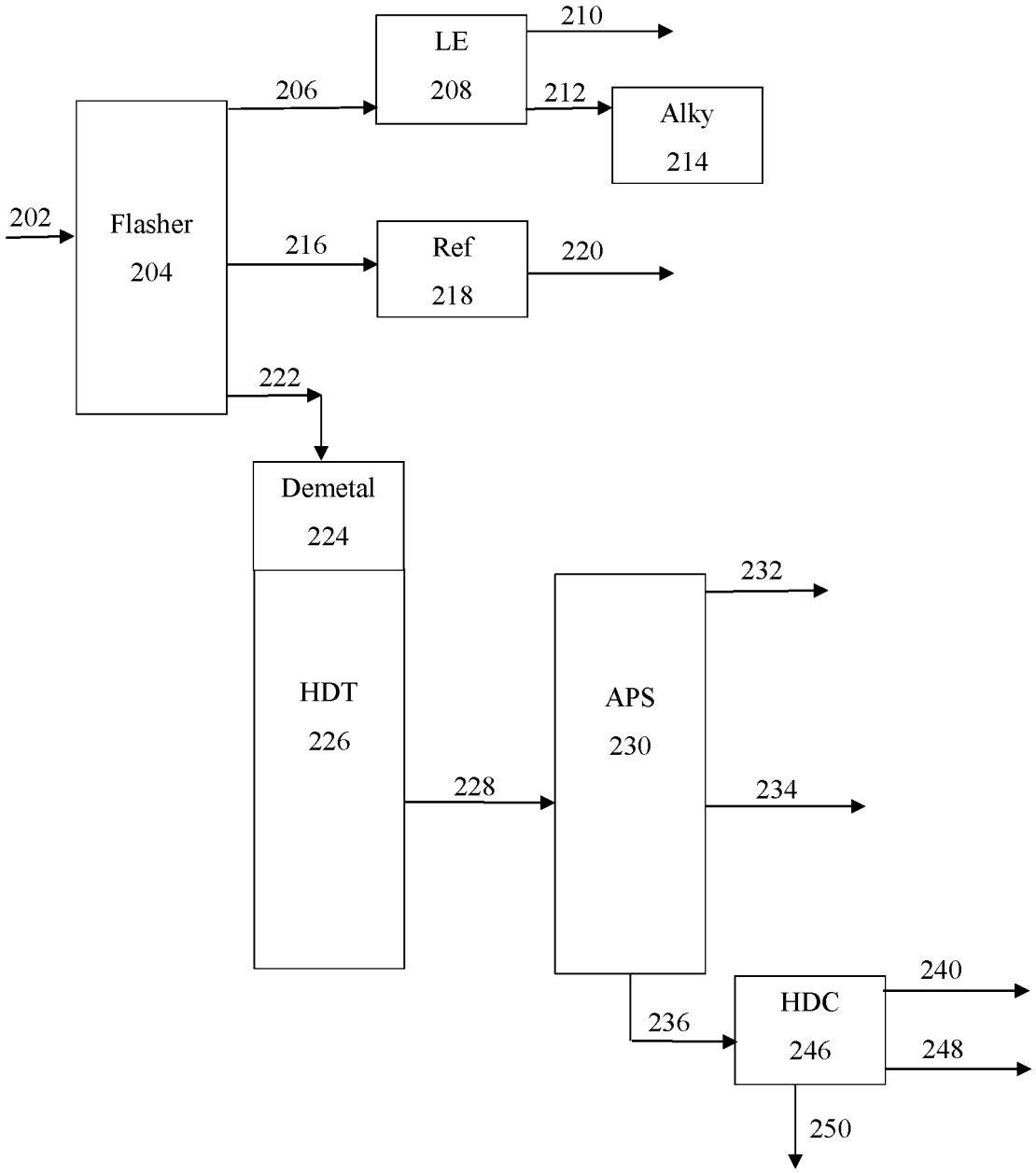
FIG. 5 depicts another aspect of a whole crude wide cut hydrotreating process flow.

FIG. 5 depicts the process flow 200 having a different atmospheric bottom end similar to the configuration depicted for process flow 100 in FIG. 2. The FCC 238 is replaced with an HDC 246 that produces three product streams: naphtha stream 240, USD stream 248, and lubricant product stream 250. Just as described above, naphtha stream 240 may still be directly blended with gasoline from the reformer stream 220 and ULSD stream 238 may be directly blended with the second petroleum distillate stream 234, which also comprises ULSD. Finally, a lubricant product stream 250, which may comprise a variety of different products, depending on the process configuration and choice of catalyst, may be produced by the HDC 246.

Figure 6:
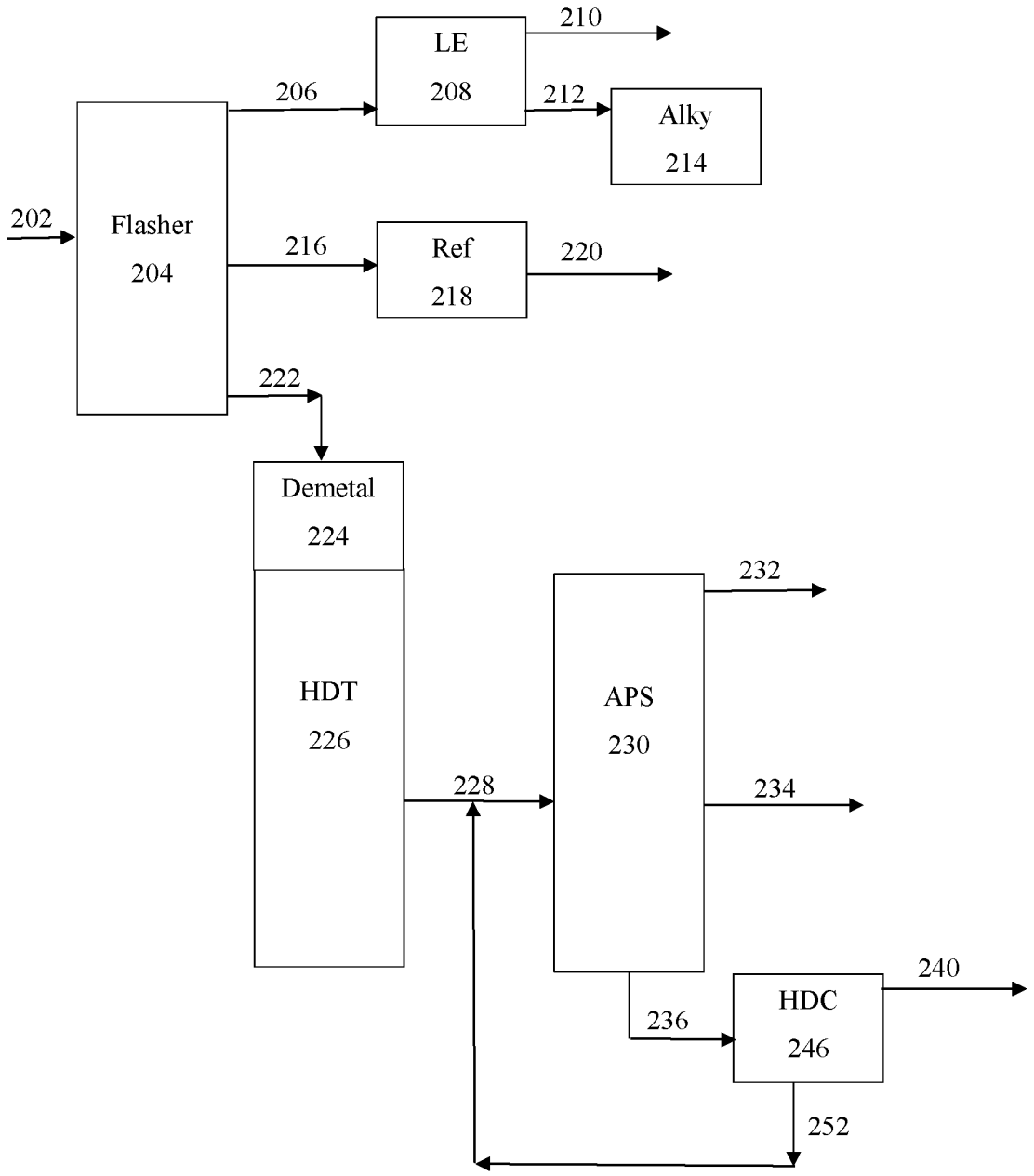
FIG. 6 depicts a further aspect of a whole crude wide cut hydrotreating process flow.

FIG. 6 depicts another possible configuration for the process flow 200 for refining low heteroatom content tight oil with a different configuration for processing the third petroleum distillate stream 236 (atmospheric bottom end). If diesel fuel is the primary target product, a HDC product stream 252 may be fed back into the atmospheric distillation tower 230 increasing the yield of ULSD in the second petroleum distillate stream 234.

Figure 7:
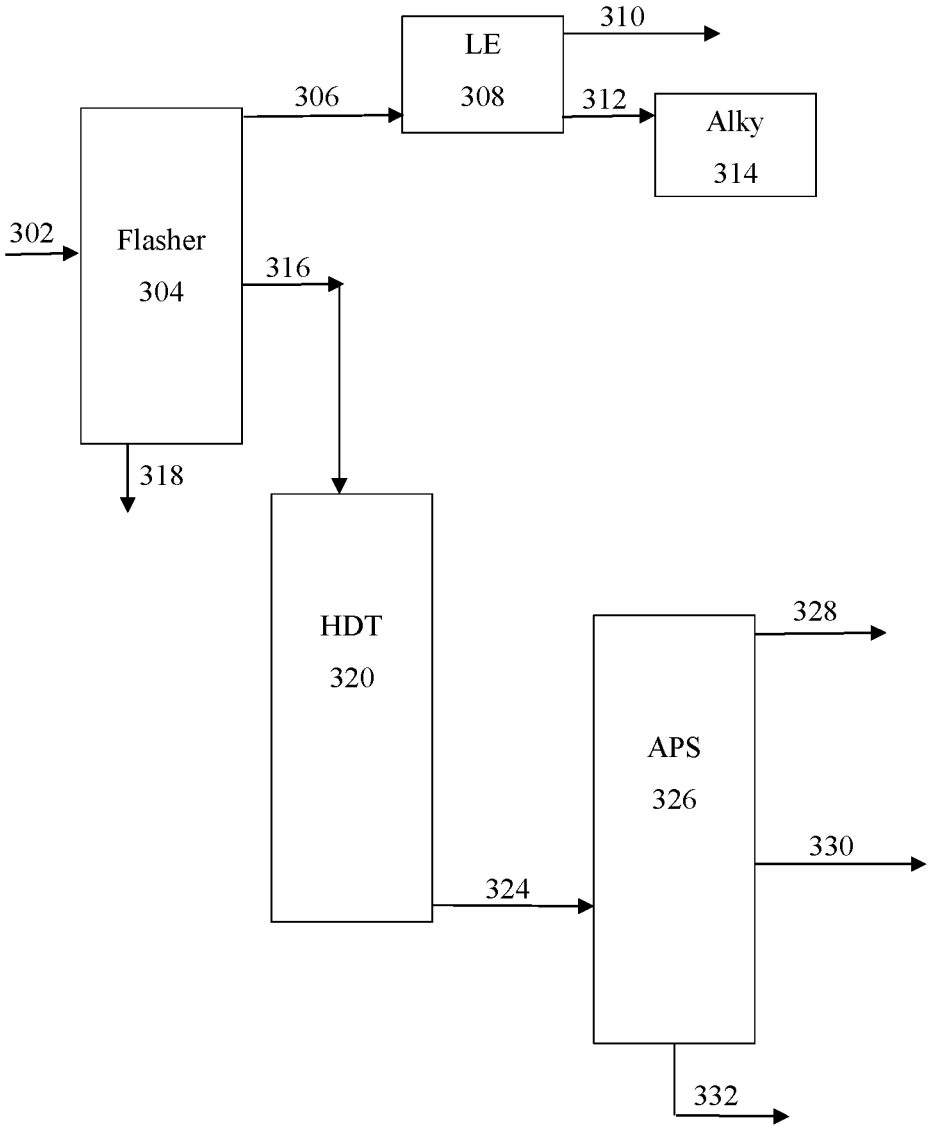
FIG. 7 depicts a further aspect of a whole crude wide cut hydrotreating process flow.

Turning now to FIG. 7, a whole crude refining process flow is depicted that refines a whole crude tight oil stream 302. Whole crude tight oil stream 302 flows into the flash separator 304 to begin the refining process. A first flash product stream 306 (flash light ends stream) comprises the same atmospheric top end distillates as the first petroleum distillate stream 112 in process flow 100 flows in to a light ends processing unit 308 to produce a light ends treated streams 310, which may contain a variety of products. The variety and composition of the light ends treated streams 310 may depend on the desired output and separation processes utilized in the light ends processing unit 308. An iso-butane stream 312 also flows from the light ends processing unit 308 into an alkylation unit 314 for further processing.

A third flash product stream 316 (flash middle stream) comprises a diesel stream that is first processed through a hydrotreating reactor 320. Having been hydrotreated, treated stream 324 enters atmospheric distillation tower 326. There the treated stream 324 is distilled into multiple petroleum distillate streams.

The distillate streams produced by the atmospheric distillation tower 326 are simplified and reduced as a result of the flash separator 304 removing the light ends components of the whole crude tight oil stream 302, such that the atmospheric distillation tower 326 produces three streams. A first petroleum distillate stream 328 comprises primarily naphtha. A second petroleum distillate stream 330 comprises ULSK and may also, in some cases, flow directly to fuel stocks without requiring further processing. A third petroleum distillate stream 330 composes ULSD. The flash bottom 318 (flash heavy ends stream) can be used as a blending component for low sulfur Marine Gas Oil (MGO), and/or sold as fuel for Emission Control Area (ECA) fuel.

Figure 8:
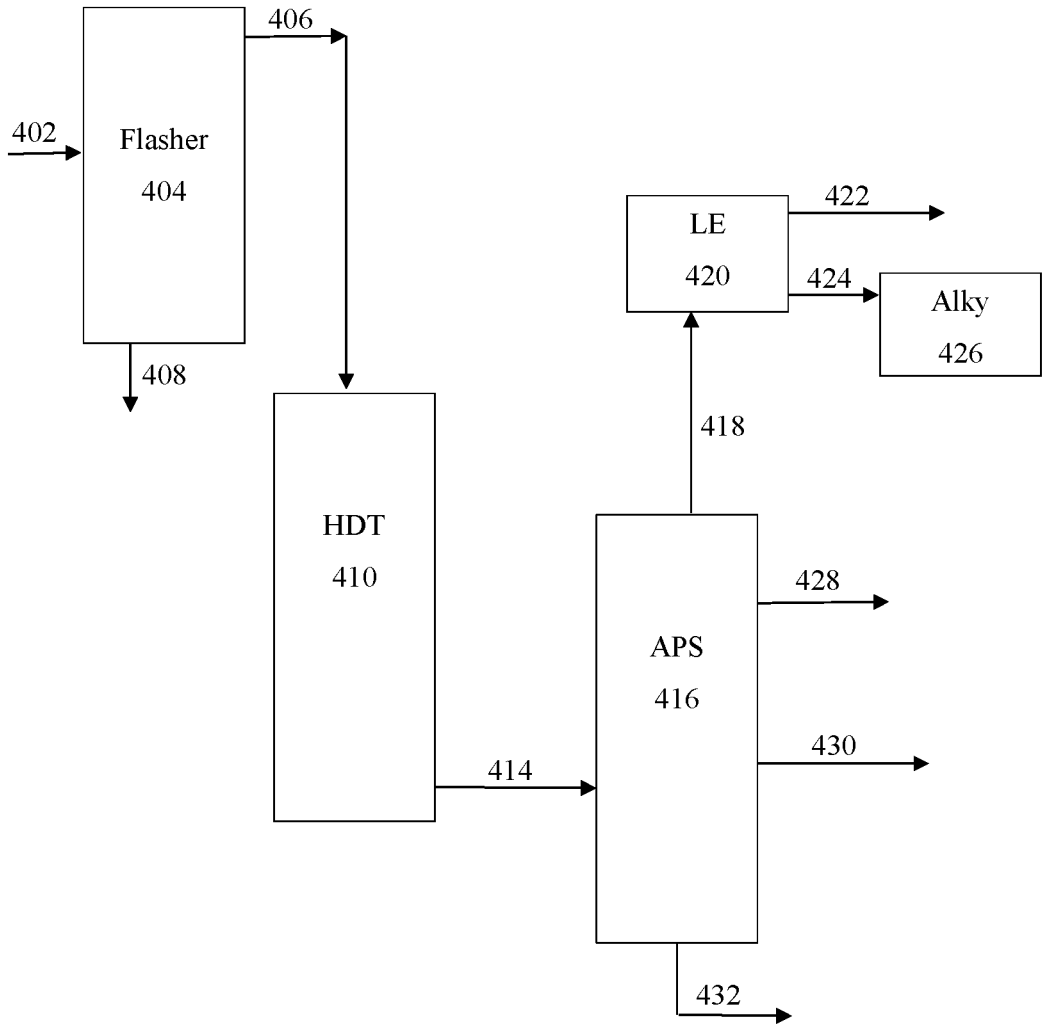
FIG. 8 depicts a further aspect of a whole crude wide cut hydrotreating process flow.

Turning now to FIG. 8, a whole crude refining process flow is depicted that refines a whole crude tight oil stream 402. Whole crude tight oil stream 402 flows into the flash separator 404 to begin the refining process. A first flash product stream 406 comprises a stream comprising diesel and lighter components, and the remainder of the whole crude tight oil stream exits the flasher through second flash product stream 408. While not shown, second flash product stream 408 may be further separated through atmospheric distillation, hydrotreating, or fluid catalytic cracking. Second flash product stream 408 can be used as a blending component for low sulfur Marine Gas Oil (MGO), and/or sold as fuel for Emission Control Area (ECA) fuel.

First flash product stream 406 exits the flasher and enters hydrotreater 410. Having been hydrotreated, treated stream 414 enters atmospheric distillation tower 416. There the treated stream 414 is distilled into multiple petroleum distillate streams.

A distillate stream 418 (light ends distillate stream) comprises the same atmospheric top end distillates as the first petroleum distillate stream 112 in process flow 100 flows in to a light ends processing unit 420 to produce a light ends treated streams 422, which may contain a variety of products. An iso-butane stream 424 also flows from the light ends processing unit 420 into an alkylation unit 426 for further processing. A second petroleum distillate stream 428 comprises primarily naphtha. A third petroleum distillate stream 430 comprises ULSK and may also, in some cases, flow directly to fuel stocks without requiring further processing. A fourth petroleum distillate stream 432 comprises ULSD.

It is contemplated that flash separating and hydrotreating a whole crude tight oil before distillation as disclosed above and depicted in FIGS. 4-8 creates significant cost and product efficiencies compared to traditional crude oil refining process flows.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

EXAMPLE EMBODIMENTS

Some embodiments of the present invention provide:

Embodiment A: Methods of refining whole crude oil, the method comprising: providing a hydrotreating reactor, a distillation tower, and an optional flash evaporation separator, and a whole crude oil stream; feeding the whole crude oil stream into the hydrotreating reactor; processing the whole crude oil stream within the hydrotreating reactor to create a treated stream, feeding the treated stream into the distillation tower; and processing the treated stream within the distillation tower to create one or more petroleum distillate streams.

Embodiment B: Methods of refining whole crude oil, the method comprising: providing a flash evaporation separator, a hydrotreating reactor, a distillation tower, and a whole crude oil stream; feeding the whole crude oil stream into the flash evaporation separator; processing the whole crude oil stream within the flash evaporation separator to create a plurality of flashed streams comprising a kero plus stream and at least one of a light ends stream and a flashed naphtha stream; feeding the kero plus stream into the hydrotreating reactor; processing the kero plus stream within the hydrotreating reactor to create a treated stream; and processing the treated stream within the distillation tower.

Embodiment C: Methods of refining whole crude oil, the method comprising: providing a flash evaporation separator, a hydrotreating reactor, a distillation tower, and a whole crude oil stream; feeding the whole crude oil stream into the flash evaporation separator to create a flash light ends stream, a flash middle stream, and a flash heavy ends stream; processing the flash middle stream within the hydrotreating reactor to create a treated stream; feeding the treated stream into the distillation tower; and processing the treated stream within the distillation tower to create one or more petroleum distillate streams.

Embodiment D: Methods of refining whole crude oil, the method comprising: providing a flash evaporation separator, a hydrotreating reactor, a distillation tower, and a whole crude oil stream; feeding the whole crude oil stream into the flash evaporation separator to create a flash light ends stream and a flash heavy ends stream; processing the flash light ends stream within the hydrotreating reactor to create a treated stream; feeding the treated stream into the distillation tower; and processing the treated stream within the distillation tower to create one or more petroleum distillate streams.

The above embodiments may be practiced along with one or more elements as follows:

Element 1: wherein the whole crude oil stream comprises at least one of a boiling point range between about T5 90° F. to about T95 1200° F. less than about 1 wt % sulfur, and less than about 35 wt % aromatics.

Element 2: further comprising: feeding the whole crude oil stream into the flash evaporation separator; processing the whole crude oil stream within the flash evaporation separator to create a plurality of flashed streams comprising a kero plus stream and at least one of a light ends stream and a flashed naphtha stream; feeding the kero plus stream into the hydrotreating reactor.

Element 3: wherein the one or more petroleum distillate streams comprises a bottom petroleum distillate stream and further comprising: providing a fluid catalytic cracker in series with the bottom petroleum distillate stream from the distillation tower; feeding the bottom petroleum distillate stream into the fluid catalytic cracker; and processing the bottom petroleum distillate stream within the fluid catalytic cracker to create at least one fluid catalytic cracker stream.

Element 4: wherein the at least one fluid catalytic cracker stream comprises at least a catalytic naphtha stream and a light cycle oil stream.

Element 5: further comprising feeding at least one of the catalytic naphtha stream and the light cycle oil stream into one or more of the petroleum distillate streams without further processing.

Element 6: wherein the one or more petroleum distillate streams comprises a bottom petroleum distillate stream and further comprising: providing a hydrocracker in series with the bottom petroleum distillate stream from the distillation tower; feeding the bottom petroleum distillate stream into the hydrocracker; and processing the bottom petroleum distillate stream within the hydrocracker to create at least one hydrocracker stream.

Element 7: further comprising: feeding the at least one hydrocracker stream into the distillation tower; and processing the at least one hydrocracker stream within the distillation tower.

Element 8: wherein the whole crude oil stream comprises at least one of a boiling point range between about 90° F. to about 1100° F. less than about 1 wt % sulfur, and less than about 20 wt % aromatics.

Element 9: feeding the flashed naphtha stream into a naphtha reformer; and processing the flashed naphtha stream in the naphtha reformer to create a reformate stream.

Element 10: further comprising: creating a first petroleum distillate stream in the distillation tower comprising an ultralow sulfur kerosene product; creating a second petroleum distillate stream in the distillation tower comprising an ultralow sulfur diesel fuel product; and creating a bottom petroleum distillate stream in the distillation tower Element 11: further comprising: providing a fluid catalytic cracker; feeding the bottom distillate stream into a fluid catalytic cracker; processing the bottom distillate stream in the fluid catalytic cracker; creating a catalytic naphtha stream within the fluid catalytic cracker; and creating, a light cycle oil stream within the fluid catalytic cracker.

Element 12: method of claim 19 further comprising processing the flash light ends stream in a light ends processing unit.

By way fo examples, some combinations of the Embodiments A-D and Elements 1-12 may include:

Embodiment A with Element 1; or Element 2; or Element 3: or Element 4; or Element or Element 6; or Elements 1 and 6; or Elements 1 and 2; or Elements 2, and 6; or Elements 6 and 8.

Embodiment B with Element 1; or Element 8; or Elements 8 aid 9; or Elements 8 and 10; or Elements 8 and 11.

Embodiment C with Element 1; or Element 8; or Elements 1 and 12; or Elements is and 12.

Embodiment D with Element 1; or Element 8.

To facilitate a better understanding of the embodiments of the present invention, the following examples of preferred or representative embodiments are given. In no way should the following examples be read to limit, or to define, the scope of the invention.

EXAMPLES

Whole crude tight oil was hydrotreated in a pilot plant unit. Feed properties and test results are shown in the following tables. Product naphtha meets the reformer requirement and product diesel meets the ultra-low sulfur diesel sulfur specification. Atmospheric bottoms can be used as a hydrocracker feed or premier a fluid catalytic converter feed or premier emission control area fuel or marine fuel oil blending component.

| | | Tight Oil Properties |
|---|---|---|
| API | | 47.5 |
| H | Wt % | 13.96 |
| S | wppm | 120 |
| N | wppm | 55 |
| SIMDIS | | |
| .5% | F. | −10 |
| 5% | F. | 132 |
| 50% | F. | 442 |
| 95% | F. | 982 |
| 99.5% | F. | 1220 |

| Catalyst | Catalyst A | | Catalyst B | |
|---|---|---|---|---|
| Temp., F. | 625 | 625 | 625 | 625 |
| Pres., psig | 500 | 500 | 500 | 500 |
| LHSV | 1 | 1.5 | 1 | 1.5 |
| TGR, scfb | 1200 | 1200 | 1200 | 1200 |
| Sulfur, ppm | | | | |
| IBP-350 F. | 0.2 | 0.3 | <0.2 | 0.3 |
| 350-700 F. | 4.9 | 9.2 | 4 | 7.3 |
| 700 F.+ | 36 | 56 | 29 | 47 |
| Nitrogen, ppm | | | | |
| IBP-350 F. | <0.2 | <0.2 | <0.2 | <0.2 |
| 350-700 F. | 4.1 | 7.1 | 5.7 | 7.6 |
| 700 F.+ | 108 | 141 | 101 | 119 |

Processes that provide a flash separator and hydrotreating reactor before the atmospheric distillation tower is capable of efficiently and economically refining a low sulfur tight oil feedstock into a variety of low sulfur products.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount, Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method of refining whole crude oil, the method comprising:

providing a hydrotreating reactor, a distillation tower, and an optional flash evaporation separator, and a whole crude oil stream, the whole crude stream comprising less than about 1 wt % sulfur;

feeding the whole crude oil stream into the hydrotreating reactor;

processing the whole crude oil stream within the hydrotreating reactor to create a treated stream;

feeding the treated stream into the distillation tower; and processing the treated stream within the distillation tower to create one or more petroleum distillate streams.

2. The method of claim 1, wherein the whole crude oil stream comprises at least one of a boiling point range between about T5 90° F. to about T95 1200° F. and less than about 35 wt % aromatics.

3. The method of claim 1 further comprising;

feeding the whole crude oil stream into the flash evaporation separator;

processing the whole crude oil stream within the flash evaporation separator to create a plurality of flashed streams comprising a kero plus remainder stream and at least one of a light ends stream and a flashed naphtha stream;

feeding the kero plus stream into the hydrotreating reactor.

4. The method of claim 1, wherein the one or more petroleum distillate streams comprises a bottom petroleum distillate stream and further comprising:

providing a fluid catalytic cracker in series with the bottom petroleum distillate stream from the distillation tower;

feeding the bottom petroleum distillate stream into the fluid catalytic cracker; and processing the bottom petroleum distillate stream within the fluid catalytic cracker to create at least one fluid catalytic cracker stream.

5. The method of claim 4, wherein the at least one fluid catalytic cracker stream comprises at least a catalytic naphtha stream and a light cycle oil stream.

6. The method of claim 5 further comprising:

feeding at least one of the catalytic naphtha stream and the light cycle oil stream into one or more of the petroleum distillate streams without further processing.

7. The method of claim 1 wherein the one or more petroleum distillate streams comprises a bottom petroleum distillate stream and further comprising:

providing a hydrocracker in series with the bottom petroleum distillate stream from the distillation tower:

feeding the bottom petroleum distillate stream into the hydrocracker; and processing the bottom petroleum distillate stream within the hydrocracker to create at least one hydrocracker stream.

8. The method of claim 7 further comprising:

feeding the at least one hydrocracker stream into the distillation tower; and processing the at least one hydrocracker stream within the distillation tower.

9. A method of refining whole crude oil, the method comprising:

providing a flash evaporation separator, a hydrotreating reactor, a distillation tower, and a whole crude oil stream;

feeding the whole crude oil stream into the flash evaporation separator;

processing the whole crude oil stream within the flash evaporation separator to create a plurality of flashed streams comprising at least a kero plus remainder stream and a flashed naphtha stream;

feeding the kero plus stream into the hydrotreating reactor;

processing the kero plus stream within the hydrotreating reactor to create a treated stream; and processing the treated stream within the distillation tower.

10. The method of claim 9, wherein the whole crude oil stream comprises at least one of a boiling point range between about 90° F. to about 1100° F., less than about 1 wt % sulfur, and less than about 20 wt % aromatics.

11. The method of claim 9 further comprising:

feeding the flashed naphtha stream into a naphtha reformer; and processing the flashed naphtha stream in the naphtha reformer to create a reformate stream.

12. The method of claim 9 further comprising:

creating a first petroleum distillate stream in the distillation tower comprising an ultralow sulfur kerosene product;

creating a second petroleum distillate stream in the distillation tower comprising an ultralow sulfur diesel fuel product; and creating a bottom petroleum distillate stream in the distillation tower.

13. The method of claim 12 further comprising:

providing a fluid catalytic cracker feeding the bottom distillate stream into a fluid catalytic cracker;

processing the bottom distillate stream in the fluid catalytic cracker;

creating a catalytic naphtha stream within the fluid catalytic cracker; and creating a light cycle oil stream within the fluid catalytic cracker.

14. The method of claim 13 further comprising:

blending the catalytic naphtha stream with the reformate stream; and blending the, light cycle oil stream with the ultralow sulfur diesel fuel product.

15. The method of claim 12 further comprising:

providing, a hydrocracker;

feeding the bottom distillate stream into the hydrocracker;

processing the bottom distillate stream in the hydrocracker.

16. The method of claim 15 further comprising:

creating a naphtha stream in the hydrocracker; and creating a high cetane hydrocracker diesel stream in the hydrocracker.

17. The method of claim 16 further comprising:

blending the catalytic naphtha stream with the reformate stream; and blending the high cetane hydrocracker diesel stream with the ultralow sulfur diesel fuel product.

18. The method of claim 15 further comprising:

creating at least one hydrocracker stream with the hydrocracker;

feeding the at least one hydrocracker stream into the distillation tower.

19. A method of refining whole crude oil, the method comprising:

providing a flash evaporation separator, a hydrotreating reactor, a distillation tower, and a whole crude oil stream, the whole crude stream comprising less than about 1 wt % sulfur;

feeding the whole crude oil stream into the flash evaporation separator to create a flash light ends stream, a flash middle stream, and a flash heavy ends stream;

processing the flash middle stream within the hydrotreating reactor to create a treated stream;

feeding the treated stream into the distillation tower; and processing the treated stream within the distillation tower to create one or more petroleum distillate streams.

20. The method of claim 19 further comprising processing the flash light ends stream in a light ends processing unit.

21. A method of refining whole crude oil, the method comprising:

providing a flash evaporation separator, a hydrotreating reactor, a distillation tower, and a whole crude oil stream, the whole crude stream comprising less than about 1 wt % sulfur;

feeding the whole crude oil stream into the flash evaporation separator to create a flash light ends stream and a flash heavy ends stream;

processing the flash light ends stream within the hydrotreating reactor to create a treated stream;

feeding the treated stream into the distillation tower; and processing the treated stream within the distillation tower to create one or more petroleum distillate streams.

22. The method of claim 21 wherein the one or more petroleum distillate streams includes a light ends distillate stream and processing the light ends distillate stream in a light ends processing unit.

* * * * *